US007474190B2

(12) United States Patent
Strzalkowski et al.

(10) Patent No.: US 7,474,190 B2
(45) Date of Patent: Jan. 6, 2009

(54) COMPONENT ARRANGEMENT WITH A PLANAR TRANSFORMER

(75) Inventors: Bernhard Strzalkowski, Munich (DE); Martin Feldtkeller, Munich (DE)

(73) Assignee: Infineon Technologies AG, Munich (DE)

( * ) Notice: Subject to any disclaimer, the term of this patent is extended or adjusted under 35 U.S.C. 154(b) by 26 days.

(21) Appl. No.: 11/657,249

(22) Filed: Jan. 24, 2007

(65) Prior Publication Data

US 2007/0120639 A1 May 31, 2007

Related U.S. Application Data

(62) Division of application No. 11/191,151, filed on Jul. 26, 2005, now Pat. No. 7,233,224.

(30) Foreign Application Priority Data

Jul. 26, 2004 (DE) ..... 102004036139

(51) Int. Cl.
*H01F 5/00* (2006.01)

(52) U.S. Cl. ..... 336/200

(58) Field of Classification Search ..... 336/65, 336/83, 200–208, 232
See application file for complete search history.

(56) References Cited

U.S. PATENT DOCUMENTS 4,951,012 A * 8/1990 Oppelt et al. ..... 333/33
5,572,179 A 11/1996 Ito et al.
6,580,334 B2 * 6/2003 Simburger et al. ..... 333/24 R
6,927,662 B2 8/2005 Kahlmann et al.
7,233,224 B2 * 6/2007 Strzalkowski et al. ..... 336/200
2004/0005009 A1 1/2004 Taghizadeh-Kaschani
2004/0056749 A1 3/2004 Kahlmann et al.
2004/0140528 A1 7/2004 Kim et al.

FOREIGN PATENT DOCUMENTS

DE 102 29 860 A1 1/2004
DE 102 32 642 A1 2/2004
JP 11307723 A * 11/1999
WO WO 98/50956 A1 11/1998

* cited by examiner

*Primary Examiner*—Tuyen T. Nguyen
(74) *Attorney, Agent, or Firm*—Maginot, Moore & Beck

(57) ABSTRACT

A component arrangement has a semiconductor body, a dielectric layer and a planar transformer. The semiconductor body includes a face. The planar transformer includes a primary winding, a first planar winding section, and a second planar winding section, each vertically spaced apart from each other. The first planar winding section forms at least a part of the secondary winding and has a first connection forming a first connection of the secondary winding. The dielectric layer is positioned on the face and isolates the primary winding from the first planar winding section. The second planar winding section is disposed between the first planar winding section and the primary winding.

9 Claims, 6 Drawing Sheets

FIG 1a Stand der Technik
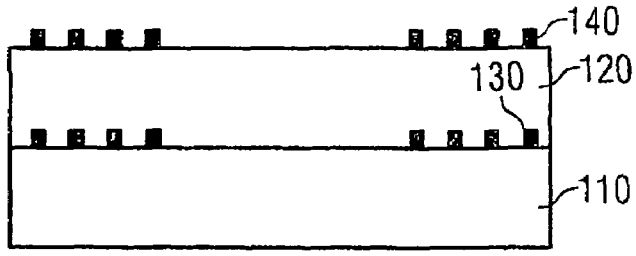
FIG 1b Stand der Technik
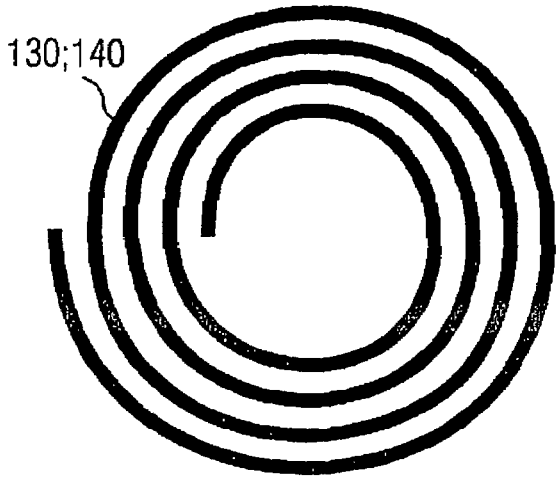
FIG 1c Stand der Technik
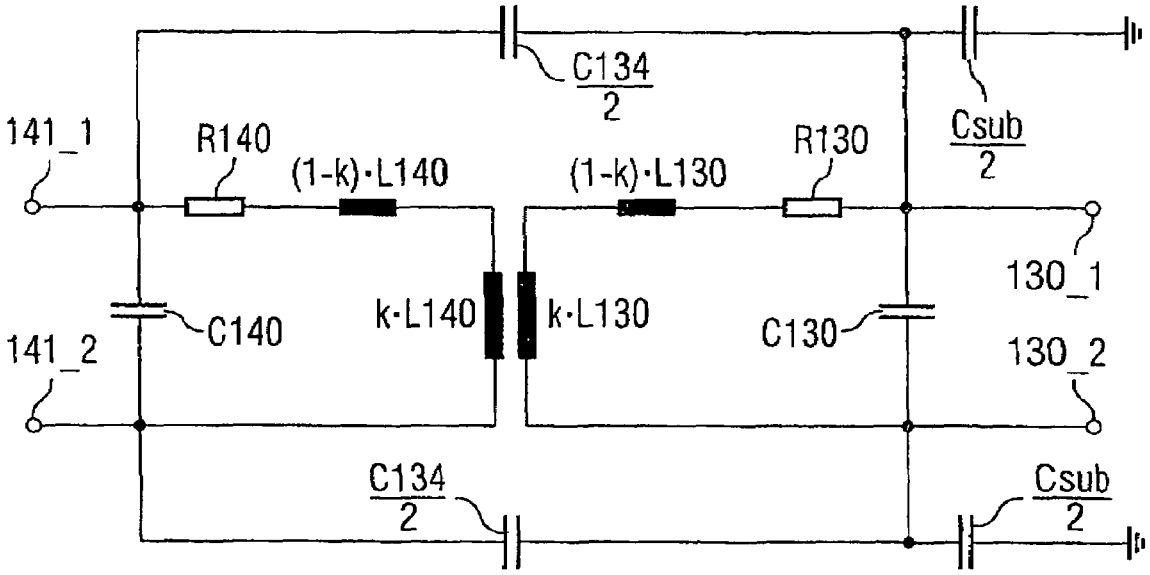

FIG 3a
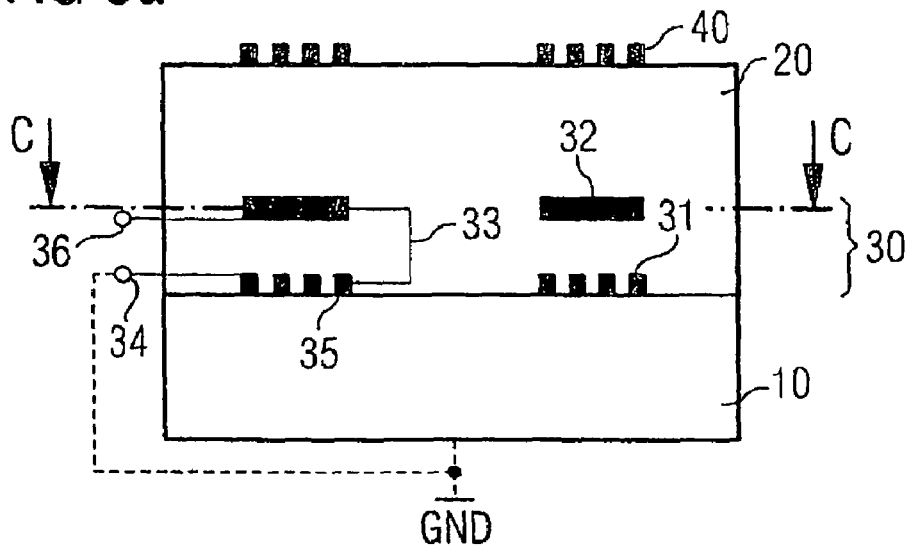
FIG 3b C-C
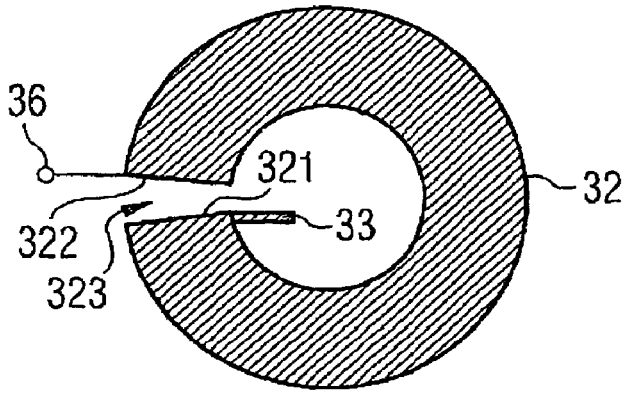
FIG 4
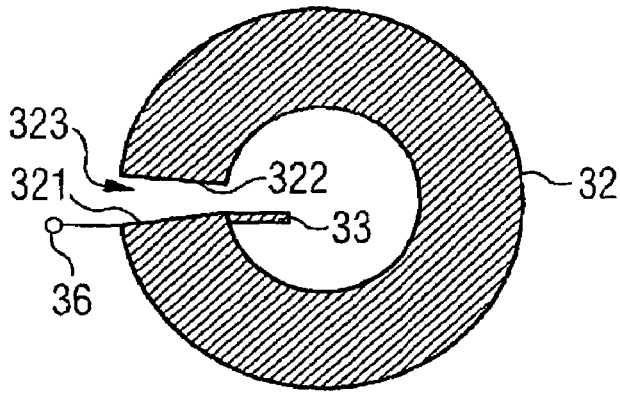

COMPONENT ARRANGEMENT WITH A PLANAR TRANSFORMER

This application is a divisional of, and claims the benefit of, prior application Ser. No. 11/191,151, filed Jul. 26, 2005.

FIELD OF THE INVENTION

The present invention relates to a component arrangement with planar transformer windings.

BACKGROUND

One component arrangement is described, by way of example, in DE 102 32 642 A1. FIG. 1 shows one such known component arrangement in the form of a side view (FIG. 1*a*), a plan view of the planar windings (FIG. 1*b*), and in the form of an electrical equivalent circuit (FIG. 1*c*).

In this component arrangement, a dielectric layer 120 is arranged on a semiconductor body 110 and electrically isolates a primary winding 140 and a secondary winding 130 of a planar transformer from one another. The secondary winding 130 is connected, for example, to integrated circuit components (which are not illustrated in any more detail) in the semiconductor body. The primary winding may be connected to other circuit components in the same semiconductor body 110 or in another semiconductor body (not illustrated). The circuit components to which the primary winding 140 is connected form, in particular, a transmission circuit, and the components to which the secondary winding is connected form, in particular, a receiving circuit for a data transmission device, in which the transformer is used as an inductive coupling element between the transmitter and receiver, and at the same time as a potential barrier between the transmitter and receiver.

The primary winding 140 and the secondary winding 130 are each arranged as a conductor loop with two or more turns on in each case one (metallization) level in the dielectric layer 120, and thus form a planar transformer without a transformer core, which is referred to in the following text as a coreless transformer.

In the equivalent circuit shown in FIG. 1*c*, C140 and C130 denote the capacitances of the primary winding 140 and of the secondary winding 130, which in each case act between connections 140_1, 140_2 and, respectively 130_1, 130_2 of the respective winding 140, 130. R140 and R130 denote the resistances of the primary winding 140 and of the secondary winding 130, and L140 and L130 denote the inductances of the primary winding and of the secondary winding 130. The coupling factor k between the primary coil is less than unity, kL140 denotes the coupling inductance on the primary side of the transformer in the equivalent circuit, and kL130 denotes the coupling inductance on the secondary side of the transformer. (1−k)L140 and, respectively (1−k)L140 denote the stray inductances, which are dependent on the coupling factor. Csub/2 denotes parasitic capacitances in FIG. 1*c*, which result from any capacitive coupling between the secondary winding 130 and the semiconductor body.

Parasitic effects also result in capacitive coupling between the primary winding 140 and the secondary winding 130. C134/2 in FIG. 1*c* denotes the parasitic capacitances which result from this and respectively occur between one of the connections 141_1, 141_2 of the primary winding 140 and one of the connections of the secondary winding 130.

Coreless transformers of the type explained above are used, for example, in half-bridge circuits for the transmission of a drive signal from a control circuit to a high-side switch in the half-bridge circuit, in order to decouple the potentials in the drive circuit and in the high-side switch. In circuit arrangements such as these, electromagnetic interference signals occur during switching processes of the high-side and low-side switches which form the half-bridge circuit and are normally in the form of power transistors, and these interference signals can induce interference voltages in the windings of the transformer. These interference voltages are produced by displacement currents in the parasitic capacitances between the primary winding and the secondary winding and may, in some circumstances, reach the level of useful signals to be transmitted.

In conventional iron-core transformers, which have been known for a long time, the effect of parasitic capacitances is reduced by the use of a shielding layer between the primary winding and the secondary winding of the transformer.

In so-called pulse transformers, which are used for signal transmission, the primary winding and the secondary winding are arranged as far apart from one another as possible on a torroidal annular core, although this does not significantly reduce the parasitic capacitances, since, as before, there is still a large capacitance between the windings and the annular core.

Differential transmission methods are known for signal transmission using planar coreless transformers, and these allow detection of interference signals which are injected into the transmission path. Methods such as these are described, by way of example, in DE 102 29 860 A1 or DE 102 28 543 A1. These transmission methods are, however, comparatively complex.

SUMMARY

One aim of the present invention is to provide a component arrangement with a planar transformer which is robust against electromagnetic interference signals when used in a signal transmission path.

This aim is achieved by a component arrangement according to embodiments of the invention.

A first embodiment is a component arrangement that has a semiconductor body, a dielectric layer and a planar transformer. The semiconductor body includes a face. The planar transformer includes a primary winding, a first planar winding section, and a second planar winding section, each vertically spaced apart from each other. The first planar winding section forms at least a part of the secondary winding and has a first connection forming a first connection of the secondary winding. The dielectric layer is positioned on the face and isolates the primary winding from the first planar winding section. The second planar winding section is disposed between the first planar winding section and the primary winding.

In the component arrangement according to some embodiments, the splitting of the secondary winding into a first and a second winding section, with one of the two winding sections being arranged between the primary winding and the other of the two winding sections, leads to a reduction in the parasitic capacitance between the primary winding and the secondary winding, and makes the component arrangement according to the invention more robust against electromagnetic interference, in comparison to conventional component arrangements with planar transformers, when using the component arrangement in a signal transmission path.

One embodiment of the invention provides for the first and second winding sections of the secondary winding each to have more than one turn. A winding sense of the first winding section in this case preferably runs in the opposite direction to a winding sense of the second winding section.

A further aspect of the invention provides for the one winding section of the secondary winding, which is arranged between the other winding section and the primary winding, to have one and only one turn, one of whose ends is separated from its other end by a gap. The dimensions of this one winding section in a lateral direction in this case correspond at least approximately to the dimensions of the other winding section in the lateral direction, or to the dimensions of the primary winding in the lateral direction.

A further aspect of the invention relates to a component arrangement which has the following features: a semiconductor body, a dielectric layer which is applied to one face of the semiconductor body, a planar transformer with a primary winding and a secondary winding, which are isolated from one another by the dielectric layer and are arranged at a distance from one another in a vertical direction with respect to the one face of the semiconductor body, a third winding, which is arranged between the primary winding and the secondary winding in the vertical direction and has one and only one turn with a first end and a second end, as well as a gap which is formed between the first and second ends, a connect link which is connected to a second connection of the secondary winding, extends in the vertical direction, starting from the second connection, as far as one level of the third winding, and runs on the plane of the third winding, through the gap, starting from a cutout which is formed by the winding.

In this component arrangement, the third winding forms a shield between the primary winding and the secondary winding, and thus ensures that the parasitic capacitance between the primary winding and the secondary winding is reduced, thus resulting in increased robustness of the component arrangement against electromagnetic interference radiation when used in a signal transmission path.

BRIEF DESCRIPTION OF THE DRAWINGS

The present invention will be explained in more detail in the following text using exemplary embodiments and with reference to figures, in which:

FIG. 1 shows a component arrangement with a semiconductor body and a transformer in the form of a cross-sectional side view (FIG. 1*a*), in the form of a plan view of the windings of the transformer (FIG. 1*b*), and in the form of an equivalent circuit (FIG. 1*c*).

FIG. 3 shows a second exemplary embodiment of the component arrangement according to the invention, in the form of a cross-sectional side view (FIG. 3*a*) and in the form of a plan view of a winding section of the secondary winding (FIG. 3*b*).

FIG. 4 shows a plan view of a winding section of the secondary winding in a component arrangement according to a further exemplary embodiment of the component arrangement.

DETAILED DESCRIPTION

Unless stated to the contrary, identical reference symbols in the figures denote identical components and their parts that have the same meaning.

Figure 2A:
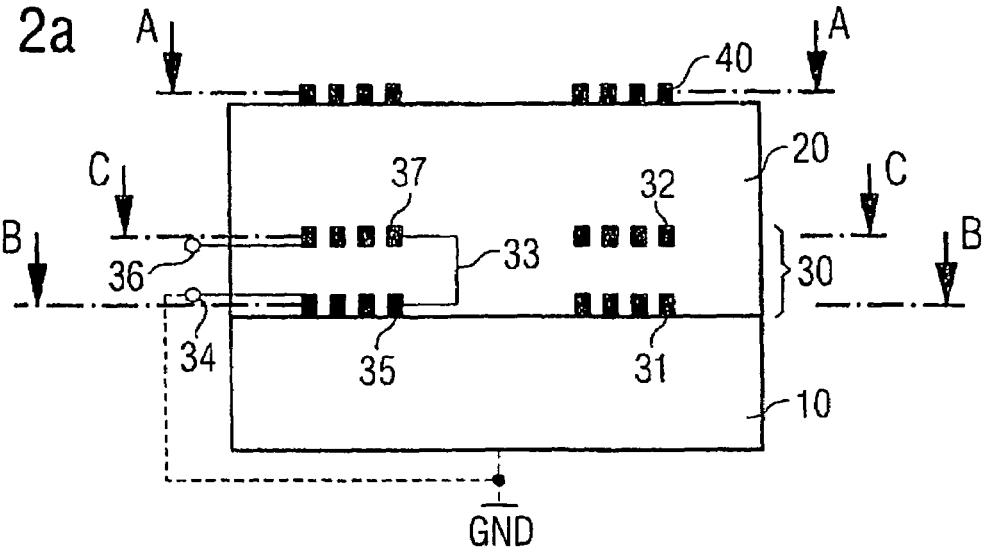
FIG. 2 shows a first exemplary embodiment of the component arrangement according to the invention, in the form of a cross-sectional side view (FIG. 2*a*), in the form of a plan view of a primary winding of a transformer (FIG. 2*b*), in the form of a plan view of winding sections of the secondary winding of the transformer (FIG. 2*c*), and in the form of an equivalent circuit (FIG. 2*d*).

With reference to FIG. 2*a*, the component arrangement according to the invention has a semiconductor body 10 and a dielectric layer 20 which is applied to the semiconductor body 10 and isolates the potentials of the primary winding 40 and of a secondary winding 30 of a planar transformer from one another. That face of the semiconductor body 10 to which the dielectric layer 20 is applied is, for example, its front face, on which contact can be made with circuit components which are integrated in the semiconductor body 10 but are not illustrated in any more detail. By way of example, the secondary winding 30 is connected to these circuit components that are integrated in the semiconductor body 10.

The secondary winding 30 of the component arrangement has two winding sections, specifically a first winding section 31 and a second winding section 32, which is arranged at a distance from the first winding section 31 in a vertical direction of the semiconductor body 10 and of the dielectric layer 20. The second winding section 32 is in this case arranged in the vertical direction between the first winding section 31 of the secondary winding 30 and the primary winding 40 in the dielectric layer 20. The dielectric layer 20 is composed, for example, of a semiconductor oxide, in particular silicon oxide. However, any desired further electrically isolating layers may, of course, also be used as the dielectric layer 20.

In the illustrated example, the first winding section 31 is located immediately adjacent to the semiconductor body 10, but with the individual turns being arranged so that they are isolated from the semiconductor body 10. An electrically conductive connection between the secondary coil 30 and the circuit components of the semiconductor body 10 is made—provided that this is desired—in a manner' which is not illustrated in any more detail, via connections 34, 36 of the secondary winding.

Figure 2B:
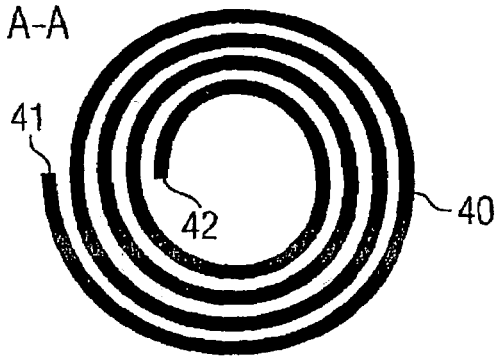
Figure 2C:
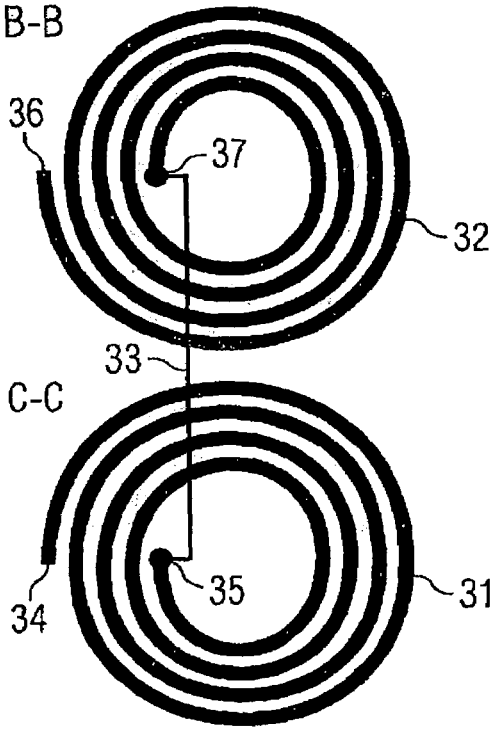

The primary winding 40 and the two winding sections 31, 32 of the secondary winding each have two or more turns, which are arranged in the form of a spiral on one level, as is illustrated in FIGS. 2*b* and 2*c*, which show cross sections through the primary winding 40 on a first section level A-A, through the first winding section 31 of the secondary winding 30 on a second section level B-B and a cross section through the second winding section 32 on a third section level C-C. These section levels A-A, B-B, C-C run parallel to the face of the semiconductor body 10 to which the dielectric layer 20 is applied.

The primary winding 40 has a first and a second end 41, 42, which each form connections of this primary winding 40. In a corresponding manner, the first planar winding section 31 and the second planar winding section 32 of the secondary winding each have first ends 34, 36, which form first connections of these two winding sections 31, 32, and each have second ends 35, 37, which form second connections of the two winding sections 31, 32. The first connections 34, 36 of the first and second winding sections 31, 32 form connections of the secondary winding 30 at which a voltage which is induced in the secondary winding 30 by the primary winding 40 can be tapped off. The connections of the secondary winding 30 are in each case formed by the "outer" connections 34, 36, that is to say the connections 34, 36 which are located on the outside in the lateral direction on the spiral winding sections 31, 32. The "inner" connections 35, 37 of the winding sections 31, 32 are formed by an electrically conductive connection 33 which runs in places in the vertical direction between a level on which the first winding section 31 is formed and a level on which the second winding section 32 is formed.

These levels on which the first and second winding sections 31, 32 of the secondary winding 30 and of the primary winding 40 as well are formed are preferably so-called wiring levels in the dielectric layer 20. These wiring levels are produced, in a manner which has been known for a long time, by successively depositing two or more layer elements of the dielectric layer 20 one above the other, in which case cutouts can be produced in each of these layer elements by means of masking and etching processes which have been known for a long time, with these cutouts being filled with an electrically conductive material before the next layer element is deposited. The structures composed of electrically conductive material form, for example, wiring for components which are arranged in the semiconductor body 10, in which case the wiring on individual levels can be connected to one another by means of vertically running connections, so-called vias. The illustrated spiral windings and winding sections may be produced by spiral structuring of the individual mask layers, in which case the windings can be connected to the semiconductor body 10 through vias.

Figure 2D:
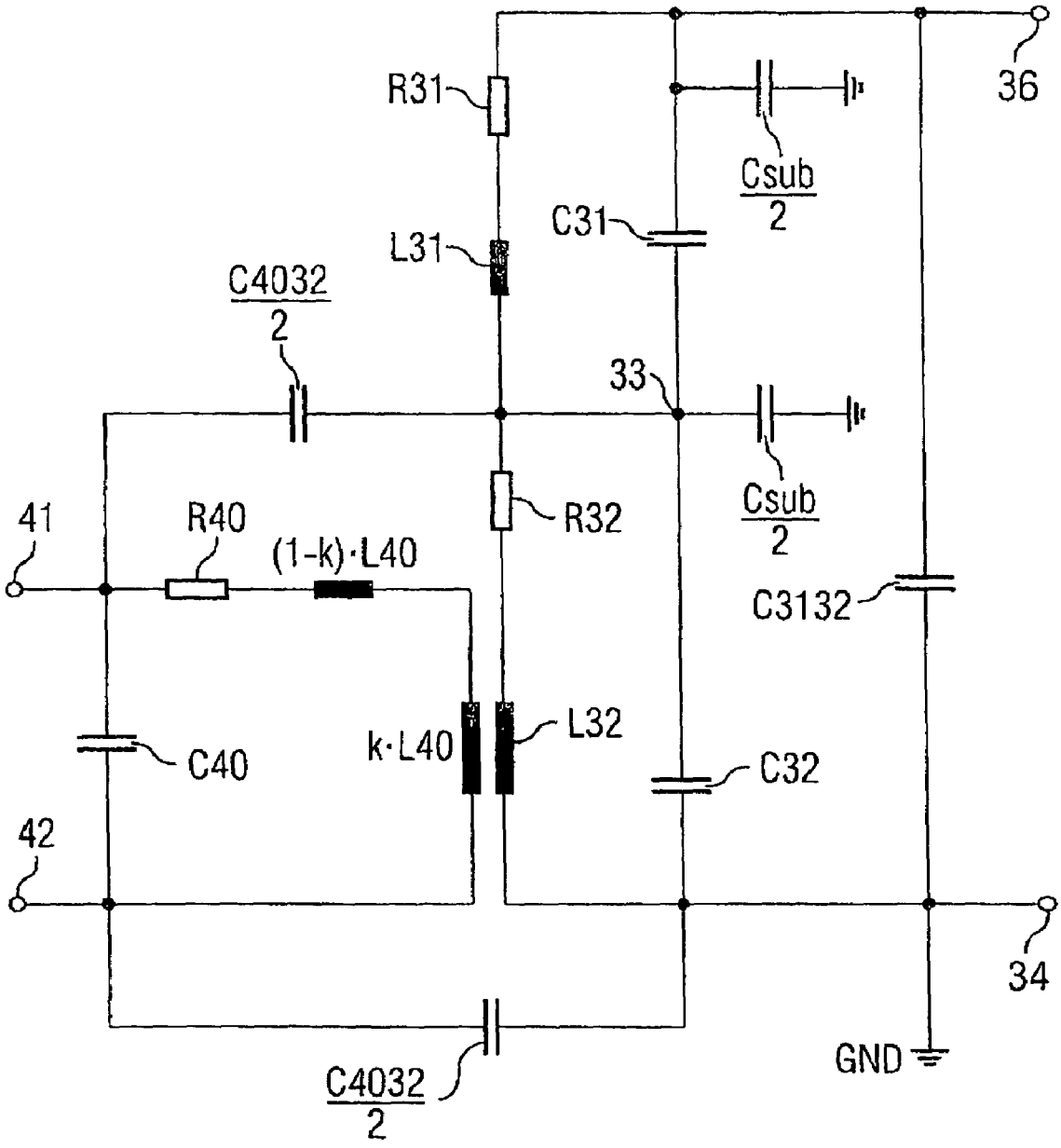

FIG. 2*d* shows the electrical equivalent circuit of the already explained component arrangement. In the equivalent circuit, the connections which correspond to the connections of the windings or winding sections 31, 32, 40 in FIGS. 2*a* to 2*c* are annotated with corresponding reference symbols.

In the equivalent circuit, C40 denotes the capacitance of the primary winding, which acts between the connections 41, 42 of the primary winding. R40 denotes the resistance of the primary winding 40, (1−k)L40 denotes the inductance value of any stray inductance which results from the inductance L40 of the primary winding, and kL40 denotes the inductance value of that component of the inductance L40 of the primary winding which is involved in the magnetic coupling. The resistance R40, the stray inductance (1−k)L40 and the coupling inductance kL40 form a series circuit between the connections 41, 42, which is connected in parallel with the winding capacitance C40. In the equivalent circuit, C31 denotes the capacitance of the first winding section 31 of the secondary winding, R31 and L31 denote the resistance and the inductance of this first winding section 31, and they form a series circuit in parallel with the capacitance C31. In a corresponding manner, C32 denotes the capacitance of the second winding section 32 of the secondary winding 30, and R32 and L32 denote the resistance and the inductance of this second winding section, and they form a series circuit in parallel with the capacitance C32. The total input capacitance between the connections 34, 36 of the secondary winding 30 is denoted C3132, and this is considerably greater than the individual capacitances C31, C32 of the winding sections 31, 32 as a result of the short distance in the vertical direction between the winding sections 31, 32.

In FIG. 2*d*, Csub/2 denotes capacitances between the winding sections 31, 32 of the secondary winding and the semiconductor body 10 or semiconductor substrate. C4032/2 denotes parasitic capacitances between one 42 of the connections 41, 42 of the primary winding and a connection 34 of the secondary winding, as well as between the other 41 of the connections 41, 42 of the primary winding and the connection 33 of the winding sections 31, 32. The first connection 34 of the secondary winding is preferably connected to a reference ground potential in the semiconductor body 10, for example to the reference ground potential on a rear face of the semiconductor body, facing away from the dielectric, as is illustrated schematically in FIG. 2*a*.

Any coupling capacitance between one of the connections 41, 42 of the primary winding 40 and the connection 36 of the secondary winding 30 is effectively negligible owing to the shielding effect of the second winding section 32, and is therefore not included in the equivalent circuit. That component of the coupling capacitance C4032/2 which acts between the connection 42 of the primary winding 40 and the connection 34 of the secondary winding has no effect on the signal transmission provided that the connection 34 of the secondary winding is connected to a reference ground potential, as is assumed in the equivalent circuit. Electromagnetic interference which is injected via the component of the coupling capacitance C4032/2 which acts between the connections 41 and 33 affects only the resistance component of the second winding section R32 and the inductive component L32.

FIG. 3*a* shows a cross-sectional side view of a further exemplary embodiment of the component arrangement according to the invention, in which the second winding section 32, which is arranged on a wiring level between the first winding section 31 of the secondary coil 30 and the primary winding 40, has one and only one turn. FIG. 3*b* shows a plan view of this second winding section 32 on the section level C-C.

With reference to FIG. 3*b*, the one turn has a first end 321 and a second end 322, which are separated from one another by a gap 323 on the wiring level on which the second winding section 32 is formed. This gap is filled by the material of the dielectric layer 20.

In the exemplary embodiment illustrated in FIG. 3*b*, the conductive connection 33 for the first winding section 31 is connected to the first end 321 of the second winding section 32, while the first connection 36 of the second winding section 32 is connected to the second end 322 of the second winding section 32, or is formed by it.

The dimensions of the second winding section 32, which has one turn, in the lateral direction are chosen such that they correspond at least approximately to the dimensions of the first winding section 31, which has two or more turns, such that the second winding section 32 shields the first winding section 31 of the secondary winding 30 from the primary winding 40.

In a further exemplary embodiment, which is illustrated in FIG. 4, the electrically conductive connection 33 is connected to the same end of the second winding section 32 which forms the first connection 36 of the second winding section 32. In this exemplary embodiment, the entire second winding section 32 is at the same potential as the second connection 35 of the first winding section 31. In this exemplary embodiment, the second winding section 32 does not significantly contribute to the inductive coupling between the primary coil 40 and the secondary coil 30, but is used essentially as shielding between the primary winding 40 and the first winding section 31, which has two or more turns, of the secondary winding 30.

FIG. 5 shows a further component arrangement with a semiconductor body 210 and a transformer whose primary winding 240 and secondary winding 230 are isolated from one another by a dielectric layer 220 that is applied to the semiconductor body 210. The primary winding 240 and the secondary winding 230 are in this case arranged, by way of example, on the wiring levels of the dielectric layer 220.

A third planar winding 250, which has only one turn, is arranged between the primary winding 240 and the secondary winding 230, on the dielectric layer, for example on a further wiring level, with a first end 251 and a second end 252 of this turn being separated by a gap 253 which is filled by the material of the dielectric layer. This third winding 250 is operated with an open circuit, that is to say its ends 251, 252 are not connected. The third winding 250 is either at a floating potential or is connected to a reference ground potential, for example to the reference ground potential to which the semiconductor body 210 located underneath it is also connected. This is normally the reference ground potential to which the rear face of the semiconductor body 210, facing away from the dielectric layer 220, is also connected.

A plan view of the geometry of the primary winding 240 corresponds, for example, to the geometry of the primary winding 40 shown in FIG. 2*b*, and a plan view of the geometry of the secondary winding 230 corresponds, for example, to the geometry of the second winding section 32 shown in FIG. 2*c*. The secondary winding 230 has a first connection 234 and a second connection 235, with the first connection 234 forming the outer connection of the planar secondary winding 230, which runs in a spiral shape, and the second connection 235 forming the inner connection of the secondary winding 230, which runs in a spiral shape. An electrically conductive connection 233 is connected to the second connection 235 and extends in places, starting from the level on which the secondary winding 230 is arranged, on the same level as that on which the third winding 250 is arranged, into a cutout 254 which is formed by the turn of the third winding 250. Starting from this cutout 254, the electrically conductive connection 233 runs on this level of the third winding 250, and extends through the gap 253 between the first and the second end 251, 252 of the third winding 250. The secondary winding 230 can be made contact with via its outer first connection 234 and that end 236 of the electrically conductive connection 233 which faces away from the second connection 235, with the second connection 235 being "passed out" from the interior of the spiral secondary winding via the electrically conductive connection 233 which, in places, runs on the same wiring level as the third winding 250. The first and second connections of the planar secondary winding 230 can in this way both be made contact with from the outside, specifically in the lateral direction alongside the secondary winding.

Figure 5A:
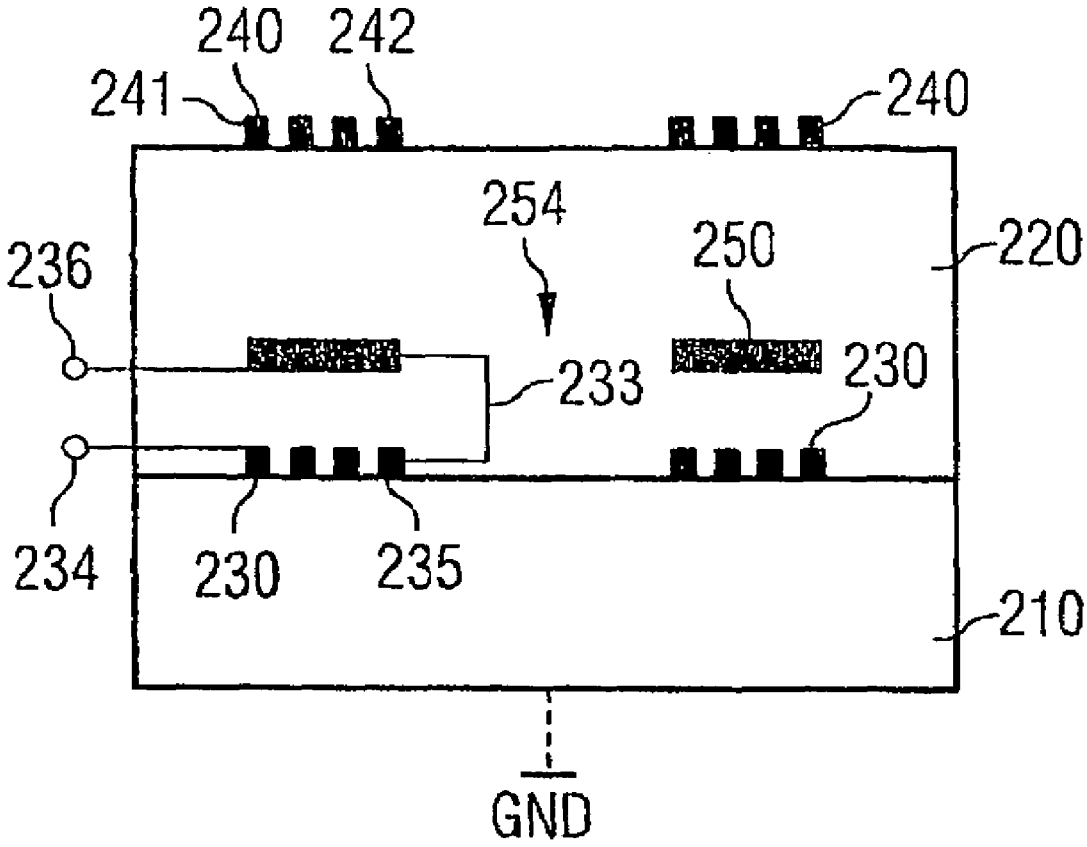
FIG. 5 shows a component arrangement according to a further aspect of the invention, in the form of a cross-sectional side view (FIG. 5*a*), in the form of a plan view of a winding which is used as a shield (FIG. 5*b*), and in the form of an equivalent circuit (FIG. 5*c*).
Figure 5B:
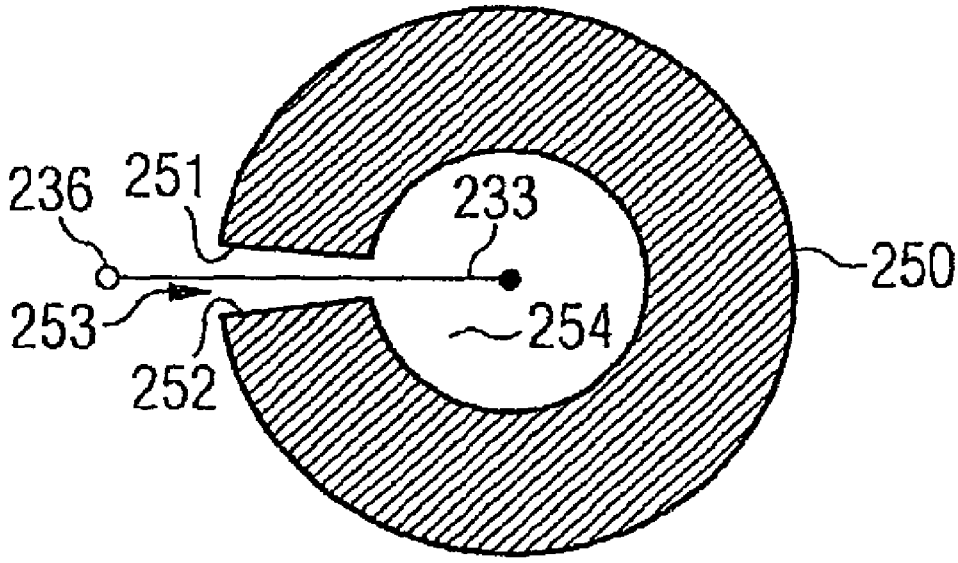
Figure 5C:
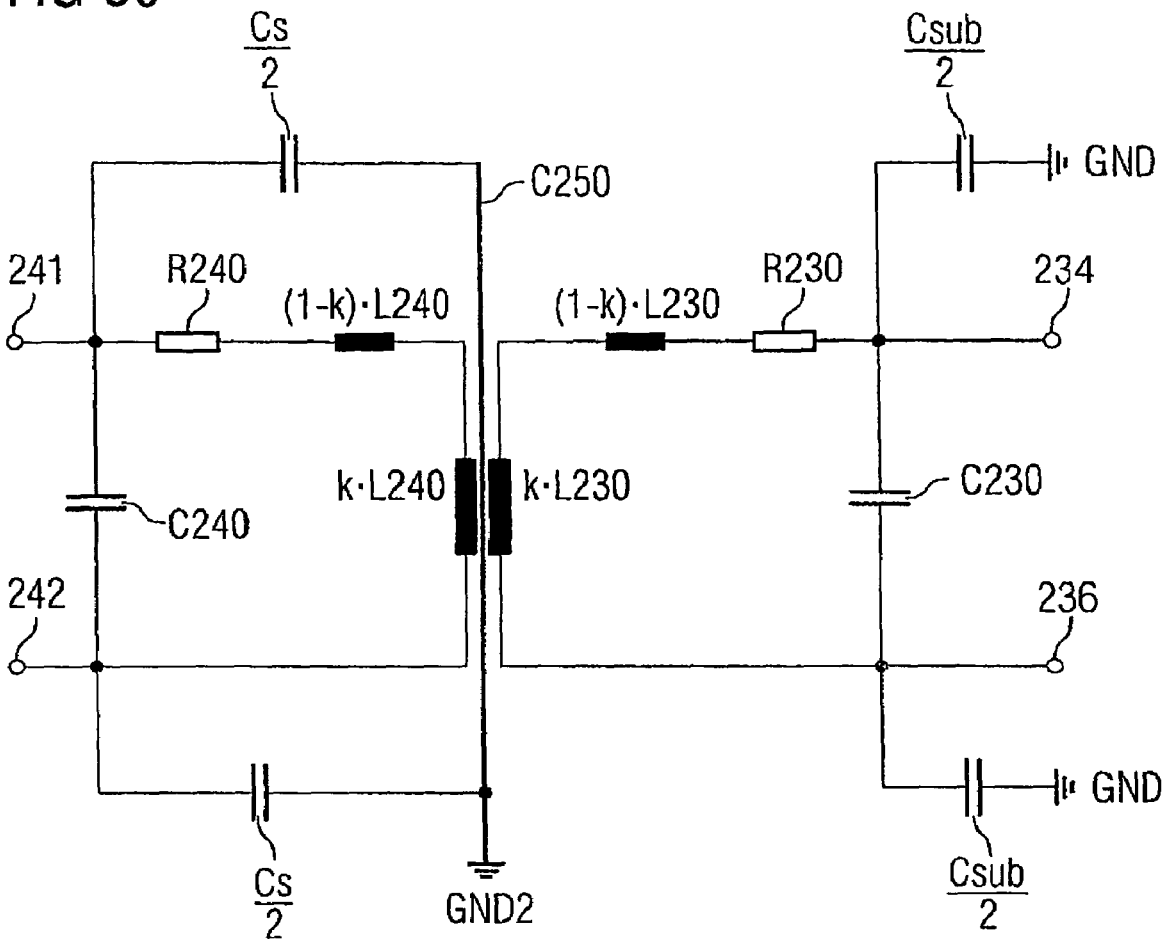

FIG. 5*c* shows the electrically equivalent circuit of the component arrangement which has already been explained with reference to FIGS. 5*a* and 5*b*.

In this equivalent circuit, C240 and C230 denote the capacitances of the primary winding C240 and of the secondary winding 230. R240 and R230 denote the resistances of the primary winding 240 of the secondary winding 230. L240 and L230 denote the inductances of the primary winding 240 and of the secondary winding 230, with kL240 and, respectively, kL230, denoting the coupling inductances which result from these inductances, and (1−k)L240 and, respectively, (1−k) L230 denoting the respective stray inductances. The resistance R240, R230 as well as the stray and coupling inductances in each case form a series circuit, which is connected in parallel with the respective capacitance C240, C230 of the windings 240, 230. In FIG. 5*c*, Csub/2 denotes the capacitances between the secondary winding and the semiconductor substrate 210.

It is preferable for no further components to be provided under the windings 230, 240 in the semiconductor body 210. In this case, the semiconductor body 210 underneath the windings 230, 240 is composed entirely just of material of one conductance type, for example of p-conductive semiconductor material. The semiconductor body 210 then represents a conductive connection between the parasitic substrate capacitances Csub/2 and the rear face of the semiconductor body 210, which is normally at a reference ground potential. This reference ground potential is denoted by GND in FIG. 5*a* and in the equivalent circuit shown in FIG. 5*c*.

As can be seen from the equivalent circuit, the third winding 250 means that there is no capacitive coupling between the connections 241, 242 of the primary winding and the connections 234, 236 of the secondary winding. The equivalent circuit is based on the assumption that the third winding 250 is connected to a reference ground potential GND2, such that, in this component arrangement, only parasitic capacitances which are denoted by Cs/2 exist between the first and second connections 241, 242 of the primary winding 240 and this reference ground potential. This reference ground potential GND2 may correspond to the reference ground potential GND to which the parasitic substrate capacitances Csub/2 are also connected. However, these reference ground potentials GND, GND2 may also differ. It is thus possible to arrange a DC voltage source between these two reference ground potentials GND, GND2, or a capacitor whose capacitance is very large in comparison to the capacitances Csub/2.

The invention claimed is:

1. A component arrangement, comprising:

a semiconductor body including a face;

a planar transformer including a primary winding, a first planar winding section, and a second planar winding section, each vertically spaced apart from each other, the first planar winding section forming at least a part of the secondary winding and having a first connection forming a first connection of the secondary winding;

a dielectric layer positioned on the face and isolating the primary winding from the first planar winding section, and wherein the second planar winding section is disposed between the first planar winding section and the primary winding; wherein the first planar winding section has more than one turn, the second planar winding section having exactly one turn, a first end, and a second end, the first and second ends separated by a gap; and dimensions of the second planar winding section in a lateral direction corresponding at least approximately to the dimensions of at least one of the first planar winding section and the primary winding.

2. The component arrangement as claimed in claim 1, in which the primary winding and the first planar winding section each have more than one turn.

3. The component arrangement as claimed in claim 1, wherein the second planar winding section forms a part of the secondary winding of the planar transformer, and is conductively connected to the first planar winding section.

4. The component arrangement as claimed in claim 3, wherein the second planar winding section has a first connection forming a second connection of the secondary winding.

5. The component arrangement as claimed in claim 3, in which the primary winding and the first planar winding section each have more than one turn.

6. The component arrangement as claimed in claim 3, further comprising:

an electrically conductive connection;

wherein the first planar winding section of the secondary winding is positioned at a first wiring level, the second planar winding section of the secondary winding is positioned at a second wiring level, the primary winding is positioned on the dielectric layer at a third wiring level, and the electrically conductive connection extends vertically with respect to the face to connect the first planar winding section of the secondary winding to the second planar winding section of the secondary winding.

7. The component arrangement as claimed in claim 3, wherein the second connection of the first planar winding section is connected to the first end of the second planar winding section, and wherein the second end forms the first connection of the second planar winding section.

8. The component arrangement as claimed in claim 3, in which the second connection of the first planar winding section is connected to the first end of the second planar winding section, and wherein the first end forms the first connection of the second planar winding section.

9. The component arrangement as claimed in claim 3, wherein which the second connection of the first planar winding section is connected to the first end of the second planar winding section, and wherein which the first end forms the first connection of the second planar winding section.

* * * * *